United States Patent [19]

Robisch et al.

[11] Patent Number: 4,589,597

[45] Date of Patent: May 20, 1986

[54] ROTARY ATOMIZER SPRAY PAINTING DEVICE

[75] Inventors: Herman Robisch, Des Plaines; Arthur T. Kroll, Oak Park, both of Ill.

[73] Assignee: Graco Inc., Minneapolis, Minn.

[21] Appl. No.: 538,204

[22] Filed: Oct. 3, 1983

[51] Int. Cl.[4] ..... B05B 5/04

[52] U.S. Cl. ..... 239/703

[58] Field of Search ..... 239/691–703, 239/704–708

[56] References Cited

U.S. PATENT DOCUMENTS

| | | | |
|---|---|---|---|
| 2,901,178 | 8/1959 | Norris | 239/703 |
| 3,344,992 | 10/1967 | Norris | 239/705 |
| 4,241,880 | 12/1980 | Hastings | 239/691 |
| 4,384,682 | 5/1983 | Sugiyama | 239/703 |

*Primary Examiner*—Joseph F. Peters, Jr.
*Assistant Examiner*—Scott Malpede
*Attorney, Agent, or Firm*—Paul L. Sjoquist

[57] ABSTRACT

A rotary atomizer spray painting device having a nonconductive fixed, axial tube for feeding paint, and having a nonconductive rotor supported for rotation in a nonconductive housing about the tube on air bearings or nonconductive ball bearings, and having turbine drive blades proximate one end thereof, the rotatable rotor supported inside of a nonconductive housing which has a high voltage electrical path therethrough, electrically connected to one or more symmetrically spaced forwardly projecting needle electrodes, the rotatable rotor being fixedly attached to a nonconductive forwardly projecting bell-shaped atomizer, the housing having pressurized air inlets for directing air in driving relationship to the turbine blades.

5 Claims, 6 Drawing Figures

ROTARY ATOMIZER SPRAY PAINTING DEVICE

BACKGROUND OF THE INVENTION

The present invention relates to rotary type atomizers for applying paint and other materials in liquid atomized form, and more particularlv relates to a rotary atomizer adapted for electrostatic paint spraying.

The use of rotary atomizers for applying paint to coating surfaces has been long known in the art. These devices typically operate by rotating a disc or cup-shaped bell at high speed, and by applying a metered flow of liquid paint to the surface of the disc or bell as it is rotating. Centrifugal forces cause the paint supplied to the surface of the disc or bell to become hurled from its edge in droplets, which droplets are then directed toward a surface to be coated.

Rotary atomizers have also been used in conjunction with electrostatic forces for the application of paint, either by placing the rotary atomizer in a highly charged electrostatic field so as to induce the atomized paint particles to accept electrostatic charges and thereby become attracted to a grounded workpiece, or by directly voltage charging the rotary atomizer and thereby causing the paint droplets to become electrostatically charged as they are emitted from the edge of the rotating disc or bell.

In applications where the atomizer itself is voltage charged, the working voltages are typically in the range of 50–150 kilovolts (kv), and therefore a high degree of care must be taken to properly protect the charged components from inadvertent contact with people or nearby objects. Such systems are typically shielded from any possible contact by means of fences, booths, or other similar shielding constructions.

The hazards of prior art electrostatic rotary atomizers have limited the type and scope of applications in which such systems may be used. For example, such systems can only be used in applications wherein sufficient spatial separation is available to provide for relative isolation of the voltage charged rotary atomizer devices, and where a high degree of control can be maintained over the spacing between the atomizer device and articles moving past the device on a conveyor line. Extreme care is required in order to prevent accidental voltage discharges in solvent or other volatile atmospheres. Since prior art atomizers are constructed of metallic materials, or contain a high percentage of metallic materials in their construction, such atomizers inherently have a high value of electrical capacitance. When charged to the voltages associated normally with electrostatic paint spraying, these atomizers accumulate a very high amount of electrical energy in the form of capacitance stored energy. Therefore, if conditions occur wherein a voltage spark is generated, the capacitive energy stored in the atomizer itself will immediately dissipate through the spark, in sufficient energy quantities so as to cause ignition of volatile solvents and the like.

Some prior art rotary atomizers attempt to minimize this problem by applying a resistive coating to the surface of the atomizer disc or bell. This approach is described in U.S. Pat. No. 2,989,241, the substance of which is to incorporate an energy damping resistance between the high capacitance components of the rotary atomizer and the workpiece. This damping resistance effectively absorbs some of the electrical energy which would otherwise be dissipated in the form of a high energy spark, and thereby reduces the hazard of fire or explosion.

Despite the foregoing and other disadvantages which result from the use of prior art rotary atomizers, such devices have found widespread use in industry, for they do produce a finely atomized cloud or spray of paint and, as a result, produce a high quality coating on a workpiece. There is therefore a need to provide a rotary atomizer having the inherent advantages of high quality painting, but without the disadvantages associated with the various hazards.

It has been found that the quality of paint atomization is directly related to the rotational speed of the rotary atomizer, the higher the rotational speed the finer the atomization. Therefore, it is not unusual to find rotary atomizers which rotate in the range of 25,000–75,000 revolutions per minute (RPM), which itself produces additional problems. Conventional bearings are difficult and expensive to design to operate at high rotational speeds, and therefore it has been the practice in the industry to design rotary atomizers having various forms of air bearings to suspend the rotating members. Such air bearings have the advantage of providing long life of the rotating members, and therefore it is desirable to incorporate them into any rotary atomizer structure which is inherently less hazardous than heretofore known in the art.

The concept of utilizing an energy damping resistance between the capacitance charged components of an atomizer and the workpiece is an advantage which is also well-known in the art, at least in the form described hereinabove. Conventional automatic and manual spray guns utilize this same concept by placement of a physical resistance in a nonconductive spray gun body, which resistance is placed proximate the front end of the spray gun to accomplish the required electrical resistance damping. This approach in a design of conventional spray guns has greatly reduced the hazards associated with such guns, and it is desirable to incorporate such a concept into a rotary atomizer. However, prior art rotary atomizers which utilized such improvements as air bearing assemblies were required to be constructed of high precision metallic components, and such components inherently prevented the use of nonconductive bodies. It is therefore desirable to combine into a single rotary atomizer structure all of the advantages heretofore known with respect to conventional spray guns, air bearing technology, and rotary atomizer technology, so as to provide a new and improved rotary atomizer having all of the advantages in each field of technology.

SUMMARY OF THE INVENTION

The present invention comprises a rotary atomizer constructed virtually entirely of nonconductive material, thereby eliminating capacitive energy storage problems and the inherent hazards which inevitably exist in an electrostatic spray gun having metallic components. A nonconducting rotatable member is contained about a fixed axial nonconducting tubular member, having air bearing contacts or nonconductive ball bearings therebetween. An outer housing of nonconductive material partially encloses the rotatable member, and an air bearing may be formed therebetween. A connecting shaft projects through the housing from one end of the rotatable member, and a disc or cup-shaped bell is constructed of nonconducting material and connected to the shaft, so as to rotate therewith. A portion of the rotatable member is formed into turbine blades, and air passages are formed through the outer housing so as to direct pressurized air against the turbine blades, and further air passages are formed through the housing to provide a source of pressurized air intermediate rotating and fixed members as an air bearing cushion. A high voltage electrical path is provided through the housing, terminating in one or more needle electrodes which project external to the housing in the region proximate the rotatable disc or bell. Further air passages may be provided through the housing to direct a source of pressurized air forwardly past the rotatable disc or bell to provide deflection and shaping air for atomized particles which are emitted from the edge of the rotating disc or bell.

BRIEF DESCRIPTION OF THE DRAWINGS

A preferred embodiment of the invention is described herein and with reference to the drawings, in which.

FIG: 1 shows an isometric view of an embodiment of the invention; and

DESCRIPTION OF THE PREFERRED EMBODIMENT

Figure 1:
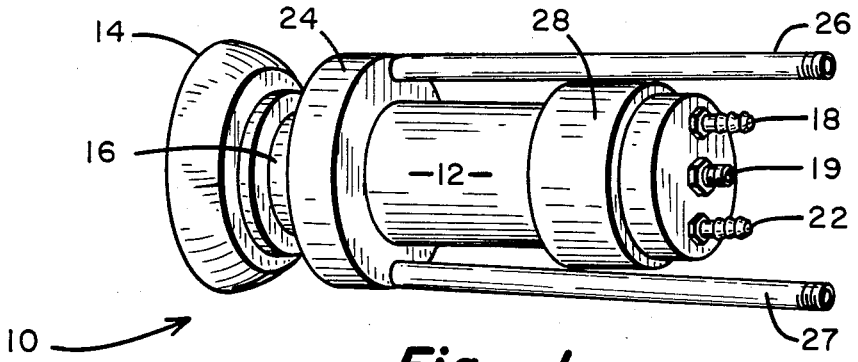

Referring first to FIG. 1, there is shown a rotary atomizer 10 constructed according to the teachings of the present invention. Atomizer 10 has an outer housing 12 constructed from nonconductive material such as nylon or plastic material. A disc or cup-shaped bell 14 is connected to a rotor shaft 16 which projects from the front of housing 12. The rear of housing 12 has a first air inlet 18 and a second air inlet 22, both of which will be hereinafter described. A liquid inlet 19 is axially positioned relative to housing 12 and rotor shaft 16. An outer cover 28 is circumferentially attached outside of housing 12. An annular housing 24 surrounds housing 12 proximate its front end, and housing 12 may be threadably attached to annular housing 24. A nonconductive tube 26 is connected to annular housing 24 near its top edge and a nonconductive tube 27 is connected to annular housing 24 near its bottom edge.

Figure 2:
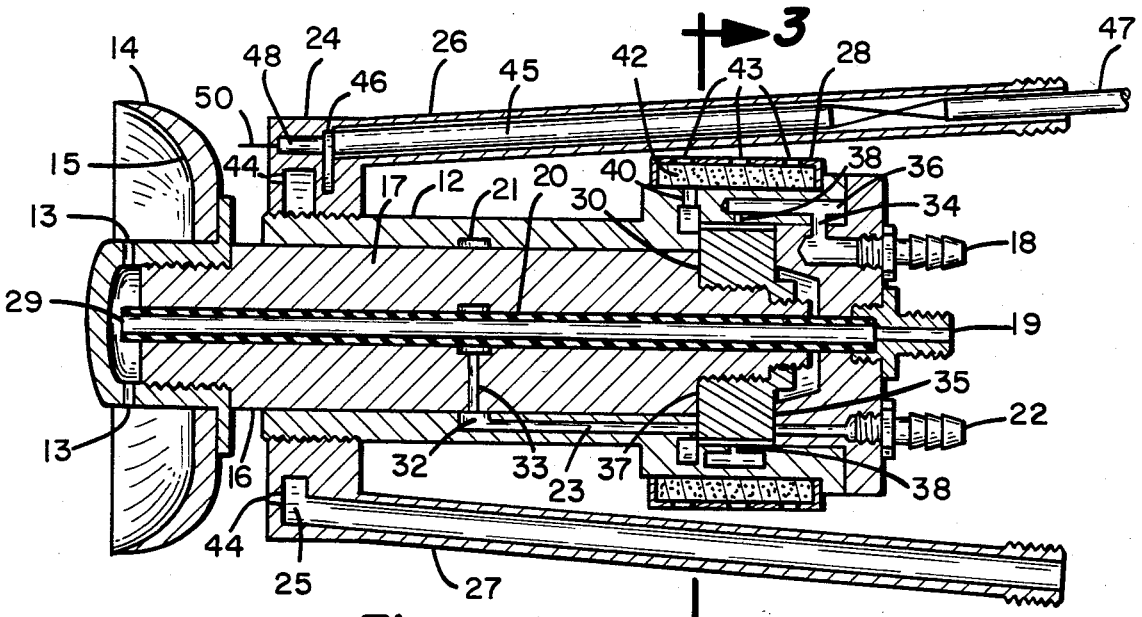
FIG. 2 shows a cross sectional view taken along the lines 2—2 of FIG. 1.

FIG. 2 shows an elevational cross-sectional view of rotary atomizer 10. Shaft 16 is formed on one end of a rotor 17, and both may be formed from a single piece constructed from nonconductive material. Shaft 16 and rotor 17 are preferably constructed from a fiberglass or ceramic material, chosen for its physical stability under widely varying conditions of temperature, humidity, and other environmental effects. Rotor 17 is closely fitted within an opening in housing 12, and has a turbine 30 constructed proximate its rear end. Turbine 30 has a plurality of circumferential blades which will be described in more detail hereinafter. Rotor 17 is concentrically mounted about a fixed, nonconductive feed tube 20. Feed tube 20 is axially positioned relative to rotor 17 and housing 12, and has a center opening along its entire length. The rear end 19 of feed tube 20 is adapted for coupling to a source of paint or other liquid, which is typically applied to feed tube 20 under slight pressure so as to cause a forward feed of the liquid to the front end of feed tube 20. The front of feed tube 20 has an opening 29 to permit liquid to be metered therethrough and to flow onto the forward surface 15 of bell 14 through openings 13. Bell 14 is fixedly attached to shaft 16 and rotates therewith.

Air inlet 22 is connected to a passage 23 inside of housing 12. Passage 23 connects to an annular groove 32 about the inner surface of the opening in housing 12, and serves to distribute pressurized air evenly about rotor 17. Pressurized air from annular groove 32 is distributed evenly over the intergap region between rotor 17 and the opening in housing 12, flowing between the respective surfaces and exhausting at either end of rotor 17. This air flow serves as an air bearing cushion between rotating rotor 17 and fixed housing 12.

A further passage 33 passes through rotor 17 to an annular groove 21 about feed tube 20. The pressurized air which is fed into annular groove 21 serves a similar purpose; namely, to provide a flow of air between rotor 17 and feed tube 20. In the preferred embodiment, the gap between the inner opening of rotor 17 and feed tube 20 may be larger than the gap between rotor 17 and housing 12. Pressurized air distributed via annular groove 21 is also provided for the purpose of maintaining a positive pressure about feed tube 20, thereby to purge foreign materials from accumulating within this region.

An air bearing surface is also created about turbine member 30, by virtue of the air flow paths described herein. The outer edge 35 of turbine 30 receives pressurized air from inlet 22, and this pressurized air creates an air cushion film between turbine member 30 and housing 12. Likewise, an air cushion film is maintained between turbine edge 37 and housing 12, so that edges 35 and 37 serve as a thrust bearing member to continue the forward and rearward movement of rotor 17 within housing 12.

Air inlet 18 is coupled to a passage 34 in housing 12, and passage 34 communicates with turbine chamber 36. Turbine chamber 36 is an annular chamber extending about turbine 30 to provide a source of pressurized air for driving turbine 30 in a rotating direction. A plurality of nozzles 38 are directed toward the blades on turbine 30, and open into turbine chamber 36. These nozzles provide a plurality of air jets for injecting pressurized air against the turbine blades and thereby to rotate the turbine. Turbine 30 is fixedly attached to rotor 17, and rotor 17 therefore rotates with turbine 30. One or more exhaust ports 40 open into the region surrounding turbine 30, and serve to exhaust pressurized air from turbine 30 into a muffler chamber 42. Muffler chamber 42 extends annularly about the exterior surface of housing 12, and may be filled with a sound insulating material to diminish the exhaust noise of pressurized air escaping from the muffler. A plurality of exterior openings 43 are drilled through the exterior wall of muffler chamber 42 in order to exhaust the air therein into the atmosphere.

Annular housing 24 is either formed as a part of housing 12 or is fixedly attached about housing 12, proximate the front end of housing 12. Annular housing 24 is connected to nonconductive tube 27, and tube 27 is adapted for connection to a further source of pressurized air. Housing 24 has an annular passage 25 extending about its interior, and a plurality of air jet openings 44 extend about housing 24 in air flow contact with passage 25. Air jets 44 are forwardly directed, and may be as many in number as thirty to ninety, and serve to provide a forwardly directed plurality of jets of air for shaping the atomized paint pattern as it develops from bell 14.

Annular housing 24 also has connected thereto a nonconductive tube 26. Nonconductive tube 26 contains the electrical circuits for electrostatically energizing the apparatus. The rear end of nonconductive tube 26 is adapted for connection to an electrical cable 47, which cable may provide high voltage to the apparatus. A large resistor 45 is located inside of tube 26, resistor 45 serving the function of damping out any capacitively stored energy which may exist in the supply cable 47. Resistor 45 is conductively coupled to an electrical contact 46 in housing 24. Contact 46 may extend annularly about housing 24, or it may be a single contact point, depending upon the particular design desired for the apparatus. A smaller resistor 48 is conductively coupled to contact 46, and the forward end of resistor 48 is connected to an electrode 50. Electrode 50 projects forwardly to serve as the source of electrostatic energy for accomplishing electrostatic paint distribution. It should be appreciated that a plurality of electrodes 50 may be dispersed about housing 24, if more than one electrode discharge point is desired. For example, in the preferred embodiment of the present invention it has been found to operate satisfactorily with four electrodes 50 positioned at approximately 90° angles about housing 24. In this case, contact 46 is extended about the interior of housing 24, and an individual resistor 48 is provided between contact 46 and electrode 50 at each of the four connection points.

Figure 3:
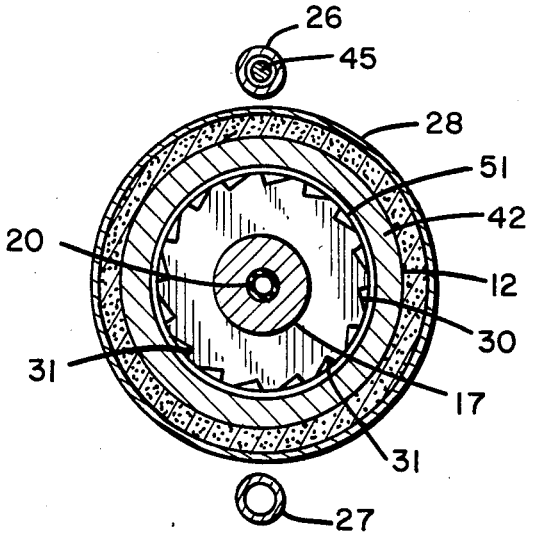
FIG. 3 shows a cross sectional view taken along the lines 3—3 of FIG. 2.

FIG. 3 shows a cross sectional view taken along the lines 3—3 of FIG. 2, wherein the structure of the turbine assembly may be noted. Turbine blades 31 are distributed equally about the outer surface of turbine 30. Turbine blades 31 are shaped so as to provide a maximum effective area for receiving pressurized air from nozzles 38. As air is used to cause rotational motion to turbine 30 it develops a positive pressure in the region around turbine 30, and must be exhausted into muffler chamber 42, and thereafter to the atmosphere. In addition, pressurized air used as an air bearing cushion 51 between rotor 17 and housing 12 is also exhausted into the atmosphere via the same path as air supplied to turbine 30.

Figure 4:
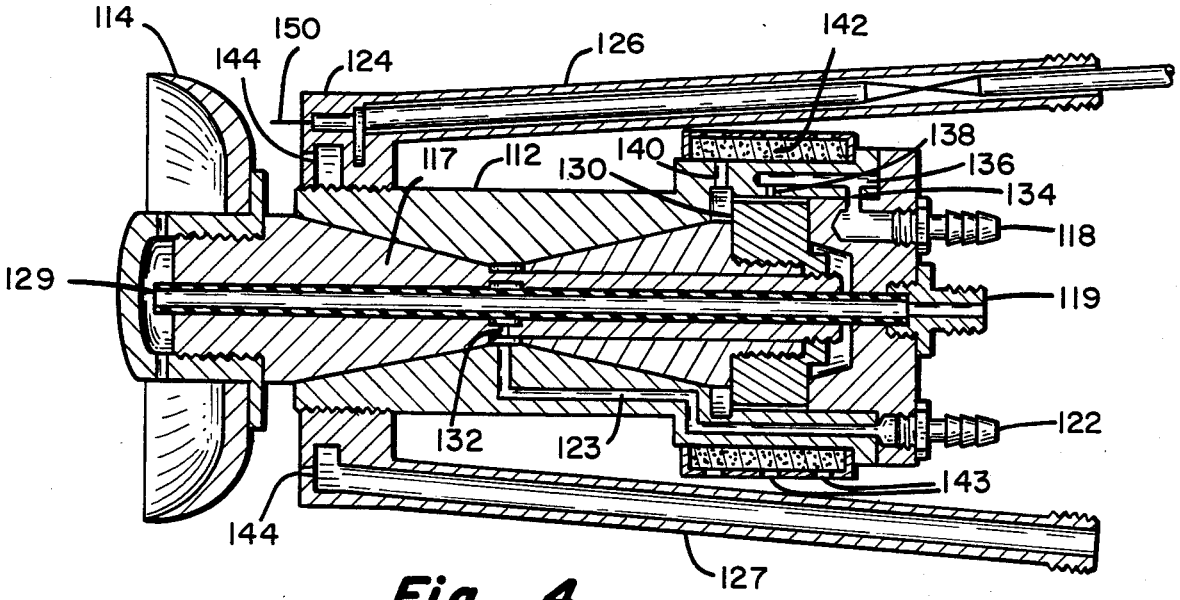
FIG. 4 shows an alternative embodiment in cross section.

FIG. 4 shows an alternative embodiment of the invention in cross section. This embodiment functions generally the same as the embodiment shown in FIG. 2, although certain constructional differences are present. A significant constructional difference is related to rotor 117, and in particular its air bearing system relative to housing 112. Rotor 117 is formed of two generally cone-shaped sections, having a narrowed center portion and extending to larger diameter end portions. Pressurized air entering air inlet port 122 is coupled through passage 123 to an annular chamber 132. Chamber 132 provides a source of pressurized air for uniformly distributing air over the external surface of rotor 117 in both directions from its narrowed center region. This film of air is flowed outwardly toward both ends from the center, and serves to provide an air bearing cushion for rotor 117. The inherent design of rotor 117 as shown in FIG. 4 eliminates the need for a thrust bearing in the apparatus, since axial thrust forces are inherently balanced by the shape of rotor 117.

Pressurized air is provided at inlet port 118, and fed through passage 134 to turbine chamber 136. From turbine chamber 136 the pressurized air passes through a plurality of nozzles 138, which inject the air against the surfaces of blades on turbine 130. This pressurized air causes turbine 130 to rotate, and thereby causes rotor 117 to rotate therewith, generating the necessary rotational motion for the apparatus. Exhaust air is collected and routed out of the turbine region via exhaust ports 140 into muffler chamber 142. From muffler chamber 142 the air is exhausted into the atmosphere through openings 143.

The function of nonconductive tube 127, and annular housing 124, and nonconductive tube 126 is essentially similar to the corresponding positioned elements described with reference to FIG. 2. For example, a plurality of forwardly directed air jets 144 may be provided in annular housing 124 for the purpose of shaping and assisting in the control of the atomization pattern from bell 114. Likewise, a plurality of electrodes 150 may be arranged about the forward surface of annular housing 124 to provide necessary electrostatic voltages for electrostatic operation.

As an alternative embodiment to the electrical circuit described herein, it is contemplated that a cascade voltage multiplier circuit may be enclosed within a conductive tube 126 or equivalent, and may thereby provide high voltage multiplication directly within the apparatus itself. In this case, the high voltage multiplier circuit need only have supplied to it a relatively low input voltage, the cascade multiplier providing the necessary voltage magnification for driving electrode 150 or equivalent. The design of appropriate cascade multiplier circuits is well-known in the art, and technology in recent years has enabled the design of such devices to be accomplished within a relatively small volume, which volume would be suitable for operation with the present invention.

Figure 5:
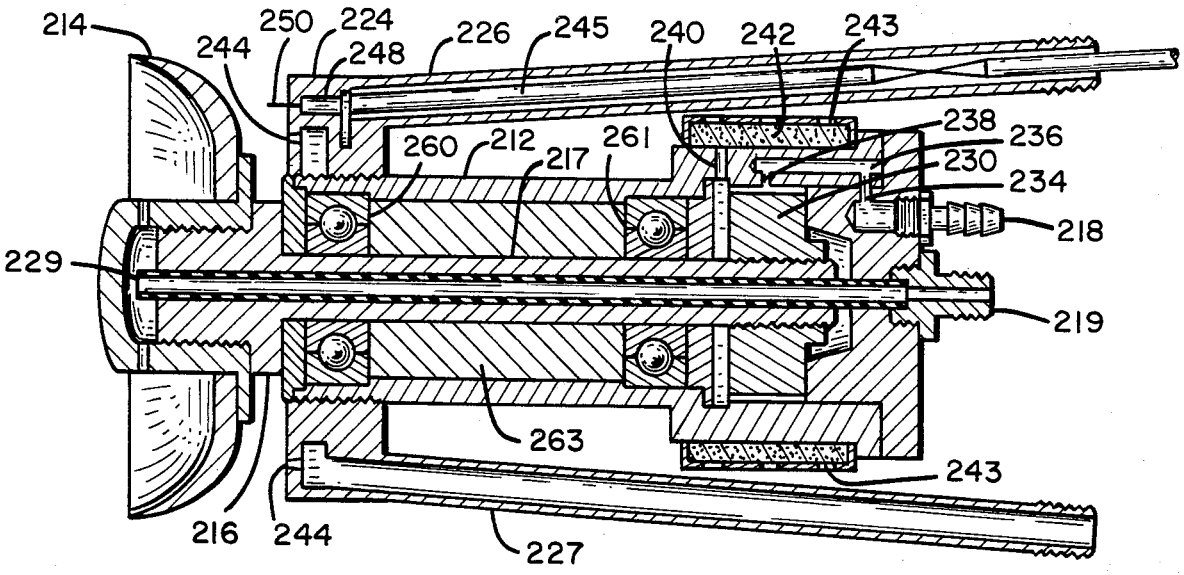
FIG. 5 shows a further alternative embodiment in cross section.

FIG. 5 shows a further alternative embodiment of the invention. A nonconductive housing 212 surrounds a rotatable rotor 217, and rotor 217 is contained by nonconductive ball bearings 260 and 261 which support rotor 217 and permit rotation thereof relative to housing 212. Rotor 217 is constructed from nonconductive material, terminating at its forward end in a projecting shaft section 216. Shaft section 216 is threadably attached to a bell or disc 214 as has been described hereinbefore. An annular nonconductive housing 224 is threadably attached proximate the forward end of housing 212, and annular housing 224 supports the electrical components including one or more electrodes 250, resistors 248, and electrical circuits 245. Annular housing 224 also includes a plurality of air jets 244 which are forwardly projecting to direct the pattern of spray particles emitted from bell 214. Turbine member 230 is fixedly attached to rotor 217, for rotation therewith, and pressurized air is deflected to rotate turbine member 230 via nozzles 238. Nozzles 238 are in flow communication with a turbine chamber 236, which in turn is coupled via passage 234 to air inlet 218. The pressurized air is exhausted from the device via exhaust ports 240 which pass the exhaust air into muffler chamber 242 and into the atmosphere via openings 243. A nonconductive spacer 263 is inserted between bearings 260 and 261, to position and hold the bearings in place.

Figure 6:
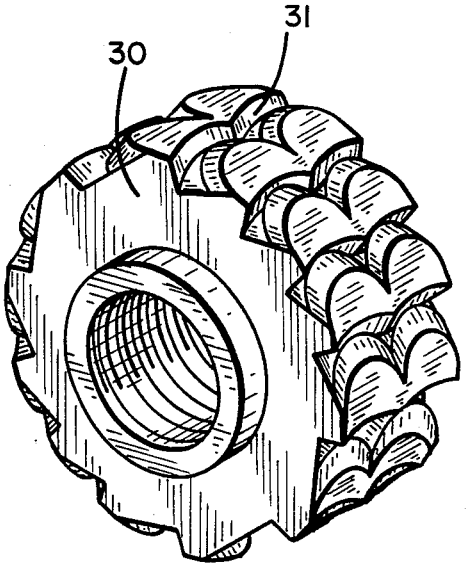
FIG. 6 shows an isometric view of the turbine member.

FIG. 6 shows an isometric view of turbine member 30, or the other similar turbine members described herein. The turbine blades 31 of turbine member 30 are curved so as to receive pressurized air proximate the center of the turbine member, and to deflect the air outwardly to both sides as the air is used to drive the turbine member in a rotatable fashion. The exhaust air is deflected outwardly along either turbine edge, and is conveyed to the atmosphere as has been described hereinbefore.

It should be noted that all of the components illustrated in the figures are constructed from nonconductive materials, with the exception of certain electrical connections. Because of the almost exclusive use of nonconductive materials there is no capacitive energy storage caused by the accumulation of voltage charges on metallic members, and therefore there is no possibility for a spark discharge to occur from this device as a result of excess capacitive energy. Therefore the use of nonconductive materials provides for an almost completely safe apparatus, and the further use of suitably sized resistors as shown in the figures provides an additional margin of safety. The only capacitively stored energy which may be identified in connection with the invention would be that energy stored in the voltage delivery cables, and the use of resistors downstream from these voltage cables suitably protects against excessive discharge currents.

It should also be appreciated that the invention contemplates utilizing independently controlled air pressure sources for driving the respective air inlets shown and described herein. For example, the pressurized air used to provide the air bearing cushion for the turbine rotor may be provided from a different air pressure regulator than the pressurized air used to drive the turbines. Likewise, the pressurized air for use in shaping the atomized pattern may be independently controllable.

In operation, the apparatus is placed in proximity to a painting zone, preferably adjacent a conveyor line adapted for conveying articles to be coated. The respective air pressures are adjusted to provide an optimum atomization pattern from the rotating bell, which may occur at rotational speeds in the range of 20,000–80,000 revolutions per minute (RPM). The pressurized air utilized to drive the turbine and the pressurized air utilized to provide the air bearing cushion may be balanced for optimum operation of the rotor at the desired RPM. Likewise, the pressurized air utilized to provide air shaping is set to provide the desired amount of control over the atomized pattern, consistent with the liquid delivery rate into the apparatus. The high voltage circuits are adjusted to provide electrostatic forces suitable for optimum paint spraying and all of these parameters may be adjusted to optimize the overall operating conditions. The apparatus may be used in conjunction with other similar devices in an automatic painting system, wherein atomizers are controllable in synchronization with articles conveyed along a conveyor line to provide a wide coating area. In this manner, large articles such as automobile bodies may be effectively coated without danger of electrical discharge.

The present invention may be embodied in other specific forms without departing from the spirit or essential attributes thereof, and it is therefore desired that the present embodiment be considered in all respects as illustrative and not restrictive, reference beinq made to the appended claims rather than to the foregoing description to indicate the scope of the invention.

What is claimed is:

1. A rotary spray atomizer adapted to receive liquid paints and the like and to distribute atomized particles of such liquids under the influence of electrostatic forces, comprising (a) a housing made entirely from nonconductive material and having an interior recess therein;

(b) a rotatable rotor made entirely from nonconductive material rotatably mounted in said recess along an axis and having an opening therethrough along said axis; said rotor and said housing having an annular space therebetween;

(c) a nonconductive dish-shaped member fixedly attached to said rotor and projecting outside said housing;

(d) a feed tube made entirely from nonconductive material, fixedly attached to said housing and extending through said rotor axial opening, said tube having a first opening proximate said dish-shaped member and a second opening outside said housing; said feed tube and said rotor having an annular space therebetween;

(e) a turbine member made entirely from nonconductive material, fixedly attached to said rotor in said housing recess, said turbine member having a plurality of projecting blades thereon;

(f) one or more conductive electrodes projecting external of said housing proximate said dish-shaped member, and means for applying a high voltage to said electrodes;

(g) means for delivering pressurized air against said turbine member blades in said housing, and means for exhausting air from said housing;

(h) means, including passages in said housing, for delivering pressurized air to said annular space between said housing and said rotor and to said annular space between said rotor and said feed tube.

2. The apparatus of claim 1, further comprising a plurality of openings through said housing in the region proximate said dish-shaped member, and air passages coupled to said openings and to a source of pressurized air.

3. The apparatus of claim 1, wherein said means for applying a high voltage to said electrodes further comprises at least one resistance member enclosed in said housing and electrically connected to said electrodes.

4. The apparatus of claim 3, wherein said means for applying a high voltage further comprises a resistance member electrically connected to each such electrode and a common electrical path connected between all such resistance members and a single source of high voltage.

5. The apparatus of claim 4, wherein said means for applying a high voltage further comprises a plurality of diode-capacitor voltage doubler circuits in series connection in said common electrical path.

* * * * *